US005980581A

United States Patent [19]

Patterson, Jr. et al.

[11] Patent Number: 5,980,581

[45] Date of Patent: Nov. 9, 1999

[54] PROCESS FOR DESIZING AND CLEANING WOVEN FABRICS AND GARMENTS

[75] Inventors: Wayne Patterson, Jr., Belmont; Robert Scott Mauney, Mooresville; Drayton Timms Virkler, Charlotte, all of N.C.

[73] Assignee: The Virkler Company, Charlotte, N.C.

[21] Appl. No.: 09/148,950

[22] Filed: Sep. 8, 1998

[51] Int. Cl.[6] ..... D06L 1/06

[52] U.S. Cl. ..... 8/138

[58] Field of Search ..... 8/115.6, 116.1, 8/125, 138

[56] References Cited

U.S. PATENT DOCUMENTS 3,991,247 11/1976 Grubb ..... 428/241
4,136,045 1/1979 Gault et al. ..... 510/452
4,178,254 12/1979 Leikhim et al. ..... 8/115.6
4,392,265 7/1983 Fujiu et al. ..... 8/120
4,711,730 12/1987 Gosselink et al. ..... 510/299

*Primary Examiner*—Caroline D. Liott
*Attorney, Agent, or Firm*—Alston & Bird LLP

[57] ABSTRACT

A process for desizing and cleaning fabrics and garments which produces a substantially desized fabric or garment while holding the dye that is removed from the garment in suspension in the bath is disclosed. The process includes the steps of immersing the woven fabric or garments in an aqueous bath containing from about 1.0% to about 8.0% owg of a desizing agent and maintaining the fabric in the desizing bath for a time sufficient to desize the goods while minimizing the removal of dye present in the goods. The desizing agent includes from about 1.0% to about 100% by weight of the desizing agent of a clay and up to about 10% by weight of the desizing agent of at least one surfactant.

17 Claims, No Drawings

PROCESS FOR DESIZING AND CLEANING WOVEN FABRICS AND GARMENTS

BACKGROUND OF THE INVENTION (1) Field of the Invention

The present invention relates to a process for desizing and cleaning dyed textile fabrics and garments. More particularly, this invention relates to a process for treating woven fabrics and garments using a desizing agent containing a material for physically removing sizing, loose color and other impurities from the goods.

(2) Description of the Prior Art

One of the most widely produced fabrics is cotton denim used to make "blue jeans" and other garments. Denim fabric is made from yarns in which the warp yarn has been dyed with indigo and/or sulfur dye.

Cotton denim fabric often contains a starch size. Removing the size typically involves soaking the fabric in a bath containing an enzyme which converts the insoluble starch to soluble sugars or dextrins. Normally desizing removes a great amount of indigo and significantly changes the cast of the shade. After the size is solubilized it is necessary to remove the soluble material before subjecting the goods to the next step. If the soluble material is not removed it may be reprecipitated in the next step or inhibit action of the chemicals that are used in subsequent steps. Streaking of the denim fabric during desizing, is the number one problem to be overcome during desizing. A second problem is to hold the dye that is removed from the garment in suspension in the desizing bath to eliminate staining of the fabrics and the garments and the need for rinsing after desizing.

It is therefore an object of the present invention to provide a process for desizing dyed woven textiles in which the sizing is substantially eliminated with minimal removal of the dye present in the garment. An additional object is to provide a process which produces a substantially desized garment while holding the dye that is removed from the garment in suspension in the desizing bath. A further object of the present invention is to provide a process that removes size in a uniform manner that prevents streaks and cracks from forming on the garment being treated.

SUMMARY OF THE INVENTION

The foregoing and other objects are achieved by using an improved process for desizing dyed woven fabrics and garments in which the textiles are immersed in an aqueous bath containing from about 1.0% to about 8.0% owg of a desizing agent. The desizing agent has from about 1.0% to about 100% by weight of the agent of a clay and up to about 10.0% by weight of the agent at least one surfactant, and maintaining the goods in said desizing bath for a time sufficient to desize the textile while minimizing the removal of dye present in the textile.

The clay is preferably a bentonite clay and is most preferably present in an amount from about 10% to about 30% by weight of the agent.

The desizing agent also preferably includes from about 2.0% to about 10% by weight of the agent of at least one nonionic ethoxylated surfactant. Preferably, the surfactant is a nonionic ethoxylated surfactant having a $C_{10}$–$C_{15}$ carbon chain with 3–12 mols of ethylene oxide present in an amount of about 6.0% by weight. Another type of surfactant that may be used is a nonionic ethylene oxide/propylene oxide surfactant having a $C_{10}$–$C_{15}$ carbon chain with 3–12 mols of ethylene oxide in an amount from about 2.0% to about 10% by weight of the agent, preferably the amount of this surfactant is about 4.0% by weight. It is frequently desirable to include both of these types of surfactants in the same desizing agent.

Additional components of the desizing agent may include from about 1.0% to about 4.0% by weight of the desizing agent of an alkali salt, such as sodium bicarbonate. A preferred amount of alkali is about 2.0% by weight. From about 0.25% to about 2.0% by weight of a defoamer, such as polydimethyl siloxane may also be included. The remainder is water.

DETAILED DESCRIPTION OF THE INVENTION

There is provided a process for treating dyed woven fabrics and garments, especially denim goods, which includes the steps of immersing the fabric or garments in an aqueous desizing bath containing from about 1.0% owg to about 8.0% owg of a desizing agent, preferably about 2.0% to about 6.0% and maintaining the fabric or garments in said desizing bath for a time sufficient to desize the fabric. As used herein the term "owg" means on weight of goods. The desizing agent includes a clay and up to about 10% by weight of the agent of at least one surfactant. While not wanting to be held to a specific theory, it is believed that the clay acts to abrade the size from the textile during agitation in the bath.

The clay is used in an amount from 1.0% to 100% by weight of the agent, preferably in an amount of from about 10% to about 30% by weight of the agent. Bentonite clays have been found to be particularly effective in the desizing process. Bentonite is a natural clay consisting of silicates and elemental oxides. The main ones being aluminum silicate, aluminum oxides, silica dioxide, magnesium oxide, calcium oxide, iron oxide, and potassium oxide. It should be understood that the invention contemplates that other clays equivalent to bentonite clays may also be used.

The desizing agent is present in an amount up to about 10.0% by, preferably from about 2.0.% to about 8.0% by weight of a surfactant. It has been found that a nonionic ethoxylated surfactant having a $C_{10}$–$C_{15}$ carbon chain with 3–12 mols ethylene oxide adduct is particularly effective when used in amounts from about 2.0% to about 10.0% by weight of the agent. Another type of surfactant that may be used is a nonionic ethylene oxide/propylene oxide surfactant having a $C_{10}$–$C_{15}$ carbon chain with 3–12 mols of ethylene oxide in an amount from about 2.0% to about 10% by weight. Preferably the amount of this type of surfactant is about 4.0% by weight of the agent. It is desirable to provide mixtures of these types of surfactants.

Additional components that may be a part of the desizing agent include from about 1.0% to about 4.0% by weight of the agent of an alkali salt, such as sodium bicarbonate in a preferred amount of about 2.0% by weight. From about 0.25% to about 2.0% by weight of the agent of a defoamer, such as polydimethyl siloxane may also be included. Other optional components include for example, lubricants and softeners. The remainder of the desizing agent is water.

In one embodiment of the present invention desizing process includes immersing the dyed fabrics or garments in a desizing bath. The goods are either passed through the bath or the aqueous bath is passed through the goods with agitation. The bath is run for about 10 to 15 minutes, drained, the goods unloaded, excess water is extracted and the goods dried.

A preferred formula for the desizing agent is as follows:

15% of a bentonite clay;

6.0% of a nonionic ethoxylated surfactant having a $C_{10}$–$C_{15}$ carbon chain with 3–12 mols ethylene oxide;

4.0% of a nonionic EO/PO surfactant having a $C_{10}$–$C_{15}$ carbon chain with 3–12 mols ethylene oxide;

2.0% Sodium bicarbonate;

<0.5% polydimethyl siloxane; and the remainder being water.

In another embodiment of the process of this invention the desizing agent can be used in an abrasion bath as a suspending agent for the loose dye to prevent redeposition, eliminating one or more rinses to remove color and residual alkali. The advantages of the desizing bath are also obtained. The process can be used as a post-scouring process in place of peroxide products, alkaline scours, or reducing agents to achieve similar effects.

There are numerous advantages of using the process of this invention. For example, in a desizing bath the process removes more than half of the size without causing streaks and cracks in the garments and fabrics. Another advantage is that the desizing process minimizes the removal of dye present in the textile and thus minimizes color pull. Additionally, the process holds the dye that is removed from the textile in suspension in the desizing bath (i.e., prevents redeposition) and the color rinses freely from the garments leaving very clean natural and dye yarns in the denim fabric. Also the process of this invention is not temperature dependent and may be run over a very broad temperature range. Furthermore, the excellent rinsing properties of the system eliminate the need for rinsing after desizing. Also, desizing of fabrics and garments does not require an amalyase enzyme step.

Use of the process of this invention keeps the shade dark, very close to the original shade of the rigid fabric.

The following examples are provided to further illustrate the present invention and are not to be construed as limiting the invention in any manner.

EXAMPLE 1

This example illustrates the benefits of using the desizing agent of this invention in a desizing bath using varying levels of bentonite clay as measured by redeposition, color pull, and residual sizing as compared to using an enzyme. A desizing agent was prepared according to the preferred formula described above using various amounts of bentonite clay.

| Test Conditions: | | | |
|---|---|---|---|
| Denim: | Burlington 2993 and 2210 | | |
| Load Size: | 7 lbs. | | |
| Machine: | 35 lb. Milnor washer/extractor | | |
| Wash Formula: | | | |
| Operation | Liquor Ratio | Time (min's) | Temp. (° F.) |
| Desize | 10:1 | 10 | 140 |
| Rinse | 10:1 | 2 | 120 |
| Rinse | 10:1 | 2 | 110 |
| Extract | | 1 | |

| Delta E (ΔE) Results: | | |
|---|---|---|
| % Clay | Redeposition | Color Pull |
| | Burlington 2210 Denim | |
| 0 | 3.27 | 5.32 |
| 15 | 1.95 | 5.06 |
| 30 | 1.94 | 4.73 |
| 48 | 2.40 | 5.68 |
| 100 | 2.60 | 5.01 |
| Amylase | 6.11 | 5.58 |
| | Burlington 2293 Denim | |
| 0 | 2.67 | 5.40 |
| 15 | 2.67 | 4.81 |
| 30 | 2.16 | 4.76 |
| 48 | 2.74 | 5.07 |
| 100 | 3.42 | 5.14 |
| Amylase | 4.28 | 5.01 |

Wherein:
0 = surfactant package applied @ 4% owg's
15 = desizing agent applied @ 2% owg's
30 = 30% Clay in desizing agent's formula applied @ 2% owg's
48 = 48% Clay in desizing agent's formula applied @ 2% owg's
100 = 100% Clay applied @ 2% owg's
ΔE was determined using AATCC Test Method 173-1992 CIE.

All trials were completed in a 35-pound Milnor washer/extractor using seven pounds of denim. The two denim styles used were Burlington 2993, an 18 indigo dip, and Burlington 2210, a 12 indigo dip. The amylase results represent a typical industry desize.

All the variations of bentonite clay in the desizing agent's formula show outstanding anti-redeposition values. Fifteen to thirty percent bentonite clay in the agent's formula appears to pull the least amount of color.

Based on the delta E results, the desizing agent, when used at 2% owg is an effective desizing dyed fabrics and garments. Optimum level of bentonite clay in the desizing agent is between 10 to 30% by weight.

EXAMPLE 2

This example is to compare a standard amylase desize against the desizing agents of the present invention.

| Test Conditions: | |
|---|---|
| Denim: | Burlington 2993 and 2210 |
| Load Size: | 7 lbs. (1:1 mix of 2993 and 2210) |
| Machine: | 35 lb. Milnor washer/extractor |

| Backstaining Results: | | | | |
|---|---|---|---|---|
| X-Rite Reading: | L | a | b | AE |
| Amylase | 47.95 | −2.65 | −10.16 | 5.83 |
| Preferred Agent | 54.04 | −2.50 | −7.03 | 2.61 |

| Abrasion Results: | | | | |
|---|---|---|---|---|
| X-Rite Reading: | L | a | b | AE |
| Amylase | 25.77 | −0.17 | −15.88 | 5.47 |
| Preferred Agent | 26.58 | −0.22 | −15.73 | 6.07 |

ΔE was determined using AATCC Test Method 173-1992 CIE.

Based on these results, desizing agents made according to the preferred formula of this invention prevents backstaining and slightly improves abrasion.

Many modifications and other embodiments of the invention will come to mind to one skilled in the art to which this invention pertains having the benefits of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation.

That which is claimed is:

1. A process for desizing dyed woven fabrics and garments comprising the steps of:

immersing said dyed fabrics or garments in an aqueous bath containing from about 1.0% to about 8.0% owg of a desizing agent comprising, from about 1.0% to about 100% by weight of said agent of a clay and up to about 10% by weight of said agent of at least one surfactant; and maintaining said dyed fabrics or garments in said desizing bath for a time sufficient to desize said fabric or garment while minimizing the removal of dye present in the fabric or garment.

2. The process according to claim 1 wherein said desizing agent is present in an amount from about 2.0% to about 6.0% owg.

3. The process according to claim 1 wherein said clay is present in an amount from about 10% to about 30% by weight of said desizing agent.

4. The process according to claim 1 wherein said clay is a bentonite clay.

5. The process according to claim 1 wherein surfactant is present in an amount of from about 2.0% to about 10% by weight of said agent.

6. The process according to claim 1 wherein surfactant is a nonionic ethoxylated surfactant having a $C_{10}$–$C_{15}$ carbon chain with 3–12 mols of ethylene oxide.

7. The process according to claim 1 wherein surfactant is a nonionic ethylene oxide/propylene oxide surfactant having a $C_{10}$–$C_{15}$ carbon chain with 3–12 mols of ethylene oxide in an amount from about 2.0% to about 8% by weight.

8. The process according to claim 1 wherein said desizing agent further comprises from about 1.0% to about 4.0% of an alkali salt, from about 0.25% to about 2.0% of a defoamer, and the remainder being water.

9. The process according to claim 8 wherein said defoamer is polydimethyl siloxane.

10. The process according to claim 1 wherein said fabrics and garments are made from denim.

11. The process according to claim 1 wherein said desizing process removes size in a uniform manner that prevents streaks and cracks from forming on the fabrics or garments.

12. The process according to claim 1 wherein said desizing process is not temperature dependent.

13. A process for desizing dyed cotton fabrics or garments comprising the steps of:

immersing said dyed fabrics or garments in an aqueous bath containing from about 1.0% to about 6.0% owg of a desizing agent comprising, from about 10% to about 30% by weight of said agent of a bentonite clay, from about 2.0% to about 10% by weight of said agent of at least one surfactant; from about 1.0% to about 4.0% of an alkali salt, from about 0.25% to about 2.0% of a defoamer, and the remainder being water; and maintaining said dyed fabrics or garments in said desizing bath for a time sufficient to desize said fabric or garment while minimizing the removal of dye present in the fabric or garment.

14. A process for desizing a dyed woven fabric or garment while holding the dye that is removed from the fabric or garment in suspension comprising the steps of:

immersing said fabrics or garments in an aqueous abrasion bath containing from about 1.0% to about 8.0% owg of a desizing agent comprising:

from about 1.0% to about 100% by weight of a bentonite clay and up to about 10% by weight of at least one surfactant; and maintaining said fabrics or garments in said aqueous abrasion bath for a time sufficient to desize the fabric or garment.

15. The process according to claim 14 wherein said desizing agent comprises:

about 15% by weight of said agent of bentonite clay; about 6.0% by weight of a nonionic ethoxylated surfactant having a $C_{10}$–$C_{15}$ carbon chain with 3–12 mols of ethylene oxide; about 4.0% of a nonionic ethylene oxide/propylene oxide surfactant having a $C_{10}$–$C_{15}$ carbon chain with 3–12 mols of ethylene oxide; about 2.0% by weight of sodium bicarbonate; and about 0.5% by weight of polydimethyl siloxane; and the remainder being water.

16. The process according to claim 14 wherein said process prevents redeposition of the dye liberated in the process.

17. The process according to claim 14 wherein said process enhances said fabrics or garments in a uniform manner by which the fabrics or garments are abraded, thereby preventing the formation of streaks and cracks.

* * * * *

UNITED STATES PATENT AND TRADEMARK OFFICE

CERTIFICATE OF CORRECTION

PATENT NO. : 5,980,581

DATED : November 9, 1999

INVENTOR(S) : Patterson, Jr. et al.

It is certified that error appears in the above-identified patent and that said Letters Patent is hereby corrected as shown below:

Column 4, line 15 (Example 1), in the sub-heading, "Burlington 2293 Denim" should read --Burlington 2993 Denim--.

Column 4, lines 54 and 60 (Example 2), last column, "AE" should read --ΔE--.

Signed and Sealed this

Eleventh Day of July, 2000

*Attest:*

*Attesting Officer*

Q. TODD DICKINSON

*Director of Patents and Trademarks*